US006109035A

United States Patent [19]

Guruprasad

[11] Patent Number: 6,109,035

[45] Date of Patent: Aug. 29, 2000

[54] MOTION CONTROL METHOD FOR CARNOTISING HEAT ENGINES AND TRANSFORMERS

[76] Inventor: Venkata Guruprasad, 35 Oak St., Apt. B6, Brewster, N.Y. 10509-1430

[21] Appl. No.: 09/036,810

[22] Filed: Mar. 9, 1998

Related U.S. Application Data

[60] Provisional application No. 60/040,739, Mar. 13, 1997.

[51] Int. Cl.[7] ..... F01B 29/00

[52] U.S. Cl. ..... 60/513; 60/515; 60/645; 60/650

[58] Field of Search ..... 60/513, 515, 645, 60/650, 668

[56] References Cited

U.S. PATENT DOCUMENTS

| | | | |
|---|---|---|---|
| 2,395,984 | 3/1946 | Bartholomew | 60/515 |
| 2,984,067 | 5/1961 | Morris | 60/513 |
| 3,194,010 | 7/1965 | Lehon | 60/513 X |
| 4,416,113 | 11/1983 | Portillo | 60/513 |
| 4,452,047 | 6/1984 | Hunt et al. | 60/515 X |

FOREIGN PATENT DOCUMENTS

| | | | |
|---|---|---|---|
| 2082683 | 12/1980 | United Kingdom | 60/515 |

*Primary Examiner*—Thomas Denion

*Attorney, Agent, or Firm*—Ostrager Chong & Flaherty

[57] ABSTRACT

Incremental control of motion in the thermodynamic phase space of a heat engine, by modulating the piston speed to control the instantaneous rate of change of temperature relative to the instantaneous heat flow during each cycle. The modulation is independent of the overall operating speed, overcoming a basic flaw in the concept of quasistatic operation that thermal leakages cannot be diminished by merely reducing the speed, and would cause the efficiency of a real engine to also vanish in the limit. The modulation and control are envisaged for more precise execution of given thermodynamic cycles, asymptotic approach to the ideal thermodynamic cycles, and emulation of the cycles of other engines by real heat engines, as well as to mechanical and electrical transformers for assuring the maximum power factors at any operating speed by executing the analogous "Carnot cycles". Additionally, mechanical heat engines are shown to have equivalent electrical forms as inductive or capacitive engines, using magnetic or dielectric thermodynamic media, respectively, so that the control analysis and design are easily translated, in reverse, to analogous mechanical forms, and hybrid engines are described potentially combining the high power of mechanical heat engines with the direct conversion capabilities of the electrical forms, so that the electrical control embodiment is as such available at the highest power levels currently achieved only by gas (mechanical) heat engines.

24 Claims, 5 Drawing Sheets

PHASE SPACE MOTION CONTROL

CAPACITIVE HEAT ENGINE

PHASE SPACE MOTION CONTROL

DIRECTION OF MOTION IN PHASE SPACE

STOKES' THEOREM IN PHASE SPACE

INDUCTIVE HEAT ENGINE

CAPACITIVE HEAT ENGINE

INDUCTIVE HEAT ENGINE USING GADOLINIUM

ELECTRO-MECHANICAL HYBRID HEAT ENGINE

MECHANICAL HEAT ENGINE MODEL

MAGNETIC CARNOT CYCLE

AMPLIFICATION AND ENERGY GAIN DIAGRAM

OPEN LOOP MOTION CONTROL FOR MECHANICAL ENGINE

MECHANICAL TRANSFORMER

MOTION CONTROL METHOD FOR CARNOTISING HEAT ENGINES AND TRANSFORMERS

This application claims the benefit of U.S. Provisional Application No. 60/040,739, filed Mar. 13, 1997.

TECHNICAL FIELD

The present invention generally relates to numerical control, heat engines and transformers. More particularly, it concerns non-sinusoidal modulation of the piston speed, independently of the overall speed of the engine, in order to control the phase space geometry of the engine cycle and to reshape it for improving the efficiency. By providing means to asymptotically approach the Carnot efficiency in real engines, the invention provides a fundamentally new development in thermodynamic theory.

BACKGROUND

A principal cause of inefficiency in heat engines is the limited temperature range available in most cases, such as under 500° C. in nuclear power plants. Another is the deviation of the engine cycle from the Carnot form, because any such deviation represents transfer of heat in and out of the engine at intermediate temperatures. This wastes the potential of the transferred heat to perform work for the balance of the operating temperature range. In principle, these losses are reversible, in that they would turn into thermal gain if the engine cycles were executed in reverse to pump heat, representing the absorption of ambient heat. Real engines additionally have irreversible losses caused by thermal leakage and by mechanical and thermal resistances; the last is due to the temperature drop that accompanies heat flow, similar to the voltage drop across an electrical resistor in proportion to the current. The temperature difference is evidently the "thermal motive force" driving the diffusion of heat, with Fick's law playing the role of Ohm's law for thermal resistance.

A common prescription for achieving Carnot efficiency is quasistatic operation, viz. the idea that both thermal and mechanical frictional losses should vanish when the engine is operated infinitely slowly. In the limit, however, the output power of the engine would also be reduced to zero, but the rate of quiescent thermal losses, which depend only on the available temperature difference, would generally remain unaffected. As a result, quasistatic operation is guaranteed by nature to destroy the efficiency altogether, so that the principle is as such inadequately conceived. The operating range of real engine speeds is in fact determined by the sum of the static (quiescent) and frictional (irreversible) losses, as the thermodynamic conversion must exceed this sum to sustain the operation of a real engine.

Since the irreversible losses can be reduced indefinitely in mechanical and electrical systems by improvements in design and engineering, it is the reversible losses, which have been neither small nor asymptotically reducible, that have been the main concern in thermodynamic theory. The reversible losses are determined solely by the phase space geometry of the engine cycle, and hitherto, the only general way for minimising these losses has been to select or design engines with the most efficient cycles, and to employ regeneration where possible. Opportunity is said to exist in magnetic refrigerators to approximate the Carnot cycle by shaping the medium and the magnetic poles, but the efficacy of the approach appears to be quite limited. Though dynamic control techniques have been applied to heat engines for over a century, the purpose and scope of the control has remained conservative. In automotive applications, for instance, the control over fuel injection and ignition timing is merely intended to maintain the engine efficiency, in effect preserving the engine cycle geometry, as the speed varies. The possibility of dynamically and continually modifying the cycle geometry has not been known at all in prior art, where the design principles generally call for cycles of fixed form, such as the diesel, Sterling or Otto cycles, and much of traditional thermodynamics has been designed to deal with integral segments of such cycles, like isothermal and isobaric processes. Prior art engines are incapable of emulating the phase space cycles of one another, since their cycles are fixed by construction and principle of operation.

Motivation for the present invention comes partly from the observation that the flywheel traditionally used for sustaining engine operation also constrains the piston to sinusoidal motion, but can be avoided in electrically operated heat engines, thus introducing a new degree of freedom, piston motion control, in engine theory. Engines using bulk magnetic or dielectric media do not perform well as replacements for gas engines because of the large thermal mass and the slowness of thermal diffusion in bulk solid media, as described by K H Spring in *Direct Generation of Electricity*, Acad. Press, 1965. The engines can be scaled to microscopic dimensions and operated at very high frequencies, however, avoiding both problems. U.S. Pat. No. 5,714,829, issued Feb. 3, 1998, entitled *Electromagnetic Heat Engines and Method for Cooling a System Having Predictable Bursts of Heat Dissipation* and incorporated herein in its entirety by reference, particularly describes their use in situations where the heat is generated within the medium, making large temperature changes available at high repetition rates, despite, and actually exploiting, the slowness of the diffusion of heat in solids. While the operational flexibility of these engines is noted in the above referenced Patent, the possibility and manner of almost-Carnot operation had remained undisclosed.

Importantly, these engines also bear a very close resemblance to electrical transformers, which is exploited both ways in the present invention, to apply control techniques taken from electrical and mechanical engineering disciplines in the design and operation of heat engines, and to translate the heat engine concepts of phase space and the Carnot cycle to electrical and mechanical machines. Furthermore, the special nature of heat is shown to make only a very specific difference in the dynamical analysis, which detracts very little from a purely dynamical perspective, thus providing new insight into the origin and limitations of the second law.

Accordingly, the principal object of the present invention is to provide a method for finely controlling the phase space path of real heat engines, in order to realise engine cycles of arbitrary forms in the phase space. A related object is to provide a method for obtaining near-Carnot efficiencies in real heat engines, and to make electrically operable heat engines more efficient.

Another related object is to provide a method for obtaining higher throughputs in power transformers even at low frequencies. A further object is to develop a unified, dynamical insight into and treatment of the transformation of power and heat.

SUMMARY OF THE INVENTION

In the present invention, these purposes, as well as others which will be apparent, are achieved generally by applying motion control techniques to control the direction of incremental motion in the phase space of heat engines and transformers. More particularly, the invention concerns varying the instantaneous piston speed in a heat engine relative to the instantaneous heat flow within the engine cycle, and analogously, varying the instantaneous speed in a transformer relative to the instantaneous input power within the transformer cycle in order to control the incremental direction of motion in the phase space of the respective cycles, thereby permitting cycles of arbitrary geometries to be executed by a given engine or transformer.

Unlike the case in prior art, where the engine speed is often dictated by the application and any variation in the ratio of the speed to the heat flow rate is merely a consequence, the piston speed variations are used in the present invention to control the very geometry of the thermodynamic cycle, and the variations involved are of finer granularity, being performed within each cycle. In existing engines, variations in speed are achieved relatively slowly over many cycles, and the piston motion remains almost perfectly uniform or sinusoidal within each cycle. In contrast, the present invention is not at all concerned with the cycle frequency or the overall engine speed, but with the optimal modulation of the piston speed over each cycle, to match the cyclic variations in the heat flow rate. Likewise, unlike the prior art of transformers, where the instantaneous load (secondary) power flow is invariably sinusoidal, the present invention requires the instantaneous load (secondary) power, as seen by the transformer, to be varied during each cycle in order to control the conversion throughput. Additional distinction lies in the reduction or elimination of flywheel inertia in the present invention, at least as seen by the engine or transformer, in order to facilitate the piston speed modulation, and the possible replacement of this inertia by an auxiliary power source for driving the "compression strokes".

The invention exploits the principle of conservation of energy, according to which the instantaneous rate of change of temperature in the thermodynamic medium of a heat engine is determined, to within the uncertainties of frictional losses and thermal transients and leakages, by the instantaneous heat transfer rate and the instantaneous power flow in or out of the medium. The rate of change of temperature, and thence the instantaneous direction of motion in the thermodynamic phase space, can be controlled, therefore, by incrementally varying the piston speed. Since a complete cycle is determined by a succession of such controlled incremental motions, the present invention provides means for approximating any desired cycle, such as the Carnot cycle, with precision limited mainly by the precision and accuracy of thermometric measurements and speed control technologies.

The conservation of energy similarly dictates that the instantaneous rate of change of a pressure-like property of a transformer's working medium would be determined by the instantaneous load (secondary) and primary power flows, again to within the uncertainties of frictional losses, transients and leakages. By varying the instantaneous load (secondary) power, the rate of change in a pressure-like property of the medium can be controlled, providing control over the direction of incremental motion in the transformer phase space and the means for approximating any desired transformer cycle with precision limited only by the precision and accuracy of the measurements and the control means used.

An illustrative embodiment ascending to the present invention comprises an electrically operated heat engine system including an auxiliary power source in place of the flywheel inertia as described; sensors to continuously monitor the instantaneous temperature and the heat flow rate, and the instantaneous load power; an optional variable immittance in the load circuit; and a control system using feedback from the sensors to control the instantaneous speed by varying one or both of the auxiliary power source and the variable immittance. The control system uses the temperature and heat flow data to compute the desired piston speed $\dot{\chi}$ according to the formula $$\dot{x} = -(\dot{q} + c_x \dot{T}) \cdot \left[ T \frac{\partial f}{\partial T}\bigg|_x \right]^{-1}, \tag{1}$$

where T is the measured temperature of the medium; $\dot{q}$, the measured heat flow rate; $c_\chi$, the effective specific heat capacity of the medium for processes in which the piston displacement $\chi$ remains constant (constant-$\chi$ processes); $\dot{T}$, the desired rate of change of temperature for the given heat flow rate $\dot{q}$ at the current point on the engine cycle in the thermodynamic phase space; and $f$, the force on the piston as a thermodynamic function of the piston displacement $\chi$ and the temperature T of the medium. It compares this computed speed $\dot{\chi}$ with the actual instantaneous piston speed $\dot{\chi}_0$, obtained from the instantaneous load power measurement, and uses known motion control methods to compute and synthesise the requisite control signals to vary either the motive force generated by the auxiliary source, or the reaction force of the variable immittance, or both, in order to correct any deviations $\delta\dot{\chi}=\dot{\chi}-\dot{\chi}_0$. Since the control changes can only occur at a finite rate and both the heat flow and the speed can otherwise change unpredictably in practice, the speed being particularly susceptible to the behaviour of the load, it is preferable to make the measurements, the computation and the control corrections continuously.

As the engine cycles are repetitive, the sensors could be omitted by arranging to issue the control signal sequence in a loop, thereby reducing the system to "open-loop control". The resulting system would be relatively inflexible and incapable of handling fluctuations in the load or the heat source, but would be simpler to implement and adequate for less demanding purposes. The cyclic nature of operation also makes it possible to employ filters for this purpose, so that the piston speed modulation can be achieved over a wide range of speeds, and, more importantly, to eliminate the need for an auxiliary source for driving the compression strokes. This idea is illustrated by a second embodiment ascending to the present invention, in which a linear actuator is incorporated in the crankshaft of a mechanical heat engine to modulate the piston speed, while keeping the flywheel and load motions uniform.

The underlying premise that $\dot{q}$ is uncontrollable and that $\dot{T}$ must be controlled in order to shape the engine cycle over the phase space, reflects the fact that $\dot{\chi}$ has been invariably constrained to sinusoidal motion by the flywheel inertia in traditional engine design, leaving $\dot{q}$ as the only variable controllable to a significant degree, such as by varying the ignition timing. The present invention is accordingly intended for use where $\dot{q}$ cannot be controlled at all, or where further improvement in the control of $\dot{q}$ already yields diminishing returns. It should be obvious, however, that the control equation could be turned around and employed to modulate $\dot{\chi}$ indirectly by controlling one of $\dot{q}$ and $\dot{T}$ with respect to the other, or to control $\dot{q}$ by controlling one of $\dot{\chi}$ and $\dot{T}$ with respect to the other; the adaptation would entail a corresponding replacement of sensors and actuators, together with the requisite computational mechanism.

The derivative $[\partial f/\partial T|_\chi]$ in eq. (1) is computed knowing the current point, determined by the instantaneous displacement $\chi$ and temperature T, and the equation of state of the medium, which is generally of the form $$f=f(\chi,T). \tag{2}$$

The generality of eq. (1) is established by observing that thermodynamic conversion is possible only because of the dependence of a force-like property of the medium $f$ on both its displacement x and an intrinsic property T that can be independently varied, so that a cyclic variation of $\chi$ can result in net work due to the difference in $f$ obtained by varying T between the two halves of the cycle. The derivative $[\partial f/\partial T|_\chi]$ signifies the net effect of the internal forces in the medium, such as van der Waals forces in real gases and the effect of coupling between the ingredients in ferrite mixtures, for example, representing an internal reactive (reversible) storage of energy u contributing the net force $$f_u = \left.\frac{\partial u}{\partial x}\right|_T, \tag{3}$$

and more commonly recognisable as the Maxwell equation $$f_u = \left(T\frac{\partial f}{\partial T} - f\right). \tag{4}$$

The heat capacity correspondingly relates to the internal energy as $$c_x = \left.\frac{\partial u}{\partial T}\right|_x. \tag{5}$$

The control equation (1) is obtained from the power balance relation $$\dot{u}+\dot{q}+\dot{w}=0, \tag{6}$$

required by the energy conservation principle, where $\dot{w}$ is the instantaneous power flow from the medium and w, the work done by the medium $$dw=f d\chi, \tag{7}$$

with all quantities, including $\dot{q}$, being denoted positive when outbound from the medium. The total energy change in the medium can be expressed as the sum of the changes due to variations in the force $f$ and displacement $\chi$ $$du = \left.\frac{\partial u}{\partial T}\right|_x dT + \left.\frac{\partial u}{\partial x}\right|_T dx = c_x dT + f_u dx, \tag{8}$$

so that eq. (6) can be rewritten as $$\dot{\chi}(f+f_u)+c_\chi\dot{T}+\dot{q}=0, \tag{9}$$

which can be manipulated to yield $$\dot{x} = -\frac{\dot{q} + c_x\dot{T}}{f + f_u}, \tag{10}$$

from which the control equation (1) follows. Using eq. (9), $f_u$ can be independently measured thermodynamically in order to accurately determine the state function $f(\chi, T)$ (eq. 2) over the expected range of engine operating conditions.

The control of transformers according to the present invention depends on analogous equations for mechanical and electrical transformers, obtained by considering a mechanical transformer, comprising a fluid working medium and a cylinder and piston on both primary and secondary sides, and writing the applicable equation of state as $$f=f(\chi,P), \tag{11}$$

where $\chi$ once again denotes the piston displacement on the load (secondary) side, $f$, the corresponding force on the load side piston, and P, the pressure within the medium. Net conversion is again possible only because P, and thereby $f$, can be varied between the two halves in a cyclic variation of $\chi$, the corresponding energy conservation law $$dw+du+dq=0, \tag{12}$$

now requiring q to be interpreted as mechanical energy on the primary side of the transformer in place of heat, involving the pressure P and the volumetric displacements du caused by the primary piston:

$$dq=P du. \tag{13}$$

A mechanical "Carnot" cycle is then construed over the phase space defined by the coordinates $f$ and $\chi$, to comprise the successive steps of A. isobaric expansion, during which P is maintained by moving the primary side piston inward, B. "adiabatic" expansion in which the primary side piston is kept stationary, C. isobaric compression while moving the primary side piston outward, and finally, D. "adiabatic" compression with the primary piston being once again locked in position.

In a differential cycle, the isobaric segments would be the only first order contributions to energy transfers, and the energy balance for a complete differential cycle is then $$d^2w+d^2q=0, \tag{14}$$

the second order differentials representing differences in the corresponding isobaric components in the two halves of the cycle, equivalent to $$df d\chi+dP du=0, \tag{15}$$

yielding $$dq = -P\left.\frac{\partial f}{\partial P}\right|_x dP dx. \tag{16}$$

The total internal energy change du again has contributions from the changes in both $\chi$ and P, so that $$du = \left.\frac{\partial u}{\partial P}\right|_x dP + \left.\frac{\partial u}{\partial x}\right|_P dx. \tag{17}$$

None of the equations (11) through (17) assume energy losses of any kind, and the differentials therefore describe only the reversible changes. In particular, the second derivative represents a reversible energy change directly associated with a physical displacement, i.e. a conservative force $$f_u = \left.\frac{\partial u}{\partial x}\right|_P, \tag{18}$$

which is clearly the net effect of inter-molecular forces on the overall behaviour of the medium, to be evaluated by combining eqs. (12) and (16) to obtain $$du = \left(P\frac{\partial f}{\partial P} - f\right)dx, \tag{19}$$

and then the analogous Maxwell relation $$f_u = \left(P\frac{\partial f}{\partial P} - f\right). \tag{20}$$

The first derivative in eq. (17) cannot be a force according to mechanics, and must be left as a coefficient $$c_x = \left.\frac{\partial u}{\partial P}\right|_x, \tag{21}$$

which is not necessarily constant. With these values, eq. (17) reduces to $$du = f_u d\chi + c_\chi dP, \tag{22}$$

and leads to the mechanical control equation $$\dot{x} = -(\dot{q} + c_x\dot{P})\cdot\left[P\left.\frac{\partial f}{\partial P}\right|_x\right]^{-1}, \tag{23}$$

which differs from eq. (1) only in uniformly replacing T with P and in interpreting q as the primary side mechanical energy instead of as heat. The analogous control equation for electrical transformers can be similarly derived, using the load current i as the force $f$, the total secondary flux $N\Phi$ in place of the displacement $\chi$, with N denoting the number of turns in the secondary coil, and interpreting P and du in terms of a suitable conjugate pair of dynamical variables on the primary side, such as the primary magnetising force or magnetomotive force $N_1 i_1$ and the resulting flux $\Phi$, $N_1$ and $i_1$ being the primary turns and current, respectively.

Equations (11)–(23) exactly parallel their thermodynamic counterparts, eqs. (2)–(10), which is to be expected because the special nature of heat, viz. the irreversibility of its flow, is immaterial to the dynamics of a heat engine, which concern only the reversible energy transfers and are therefore fully and fundamentally determined only by the conservation of energy. In particular, q refers only to the heat entering and leaving the medium in eqs. (2)–(10), so that the non-reusability of the rejected heat in the succeeding cycles is extraneous to the thermodynamic relations. Correspondingly, q refers, in eqs. (11)–(23), to the energy entering or leaving the medium on the primary side of the transformer, and its reusability by recirculation on the primary side is extraneous to the dynamical relations of the transformer. The two sets of equations therefore have the same form and lead to essentially the same control equation, and the same control techniques can indeed be adopted for the "mechanical Carnot" cycle as both sets of controlled variables are purely dynamical and occur only on the mechanical or electrical load (secondary) side.

The irreversibility of heat does matter outside of the dynamical issues, however, because a continuous consumption of heat is implied in operating an engine, quantifiable as a continuous increase in the entropy of the environment $$\dot{s} = \dot{q}\left[-\frac{1}{T_h} + \frac{1}{T_l}\right], \tag{24}$$

the two terms denoting the changes due to the heat intake and exhaust, respectively. This rate of increase must occur irrespective of whether the thermal energy is dissipated to $T_l$, presumably the ambient temperature, at one point or spread over several locations. An ideal heat engine produces no entropy in its immediate vicinity, and the consumption of its mechanical output power, meaning its eventual dissipation into the environment, accounts for the entropy production required by eq. (24). A real engine would have a lower efficiency, $\eta$, producing $$\dot{s}_e = \dot{q}\left[-\frac{1}{T_h} + \frac{1-\eta}{T_l}\right] \tag{25}$$

at the engine and $$\dot{s}_L = \dot{q}\frac{\eta}{T_l} \tag{26}$$

at the point of consumption of its output (the load). It would seem that the wastage ratio $(1-\eta)$ could have any value so long as the sum $\dot{s}_e+\dot{s}_L$ remained equal to $\dot{s}$. The irreversibility of heat flow however guarantees that neither of these component entropy changes can be negative, so that the minimum entropy at the engine is at best zero and yields the Carnot value $\eta_c=1-T_l/T_h$, same as the efficiency of the differential cycle producing $$d^2 w \equiv df\,dx = -dq\frac{dT}{T} \equiv -ds\,dT,\ \eta_c \equiv \frac{dT}{T}. \tag{27}$$

Similar "entropy changes" could be defined for a mechanical transformer, using P in place of T in eqs. (25) and (26), but the reusability of the rejected energy makes such a notion useless. The special nature of heat is thus contained essentially in the effect on the environment, and not in the engine itself or its thermodynamic medium, since none of the dynamical relations preceding eq. (25) are affected. In particular, it is now easy to see, by considering the phase space of the transformer, that the "mechanical Carnot" cycle (steps A–D above) must yield the maximum conversion, or power factor, between any given pair of limiting pressures and displacements, regardless of the operating frequency and the form of the equation of state, eq. (11), and conversely, that any other cycle, such as one resulting from the usual sinusoidal operation, must have a lower throughput, which establishes the theoretical utility of the transformer control proposed above (eq. 23).

The foregoing distinction between the thermal and dynamical aspects of heat engine theory conversely allows one to identify T as the thermal counterpart of the pressure P, and the entropy s, by its thermodynamic definition $$dq = T\,ds, \tag{28}$$

providing the thermal equivalent of the mechanical work Pdu, as the displacement dynamical variable conjugate to T. Correspondingly, every heat flow is associable with an "entropy current"

$$\dot{q}=T\dot{s} \tag{29}$$

for which the corresponding "Ohm's law" defining thermal resistivity $$\rho \sim \delta T/\dot{s} \tag{30}$$

is recognisable as Fick's law, demonstrating the consistency of the dynamical interpretation of heat. Moreover, while the corresponding ratio dP/P cannot be likewise regarded as an efficiency of the differential cycle, it does signify the net conversion $$d^2 w \equiv d f d x = -d q \frac{d P}{P} \equiv -d v d P \tag{31}$$

of a unit quantity of primary energy. In electrical terminology, the throughput $d^2w$ represents the active power flow from the primary to the secondary (load) and the total primary energy supplied in a cycle is the sum of this active power and the reactive power that circulates back to the power source driving the primary side, so that the ratio dP/P literally constitutes the effective power factor, despite the fact that the piston motion in a "mechanical Carnot" cycle is hardly sinusoidal.

Advantage in the present invention principally lies in the resulting ability to make the thermodynamic cycle of almost any real heat engine closely approximate an ideal cycle, in order to realise higher efficiency of power conversion approaching the Carnot limit; in being able to simulate the cycles and performance of a wide variety of existing heat engines using electrically operable engines to which existing motion control technology can be readily applied: in being able to realise direct electric conversion at near Carnot efficiency using electrically operated heat engines; and in the indefinite improvement possible as motion control technology itself continues to improve over time. Advantage similarly lies in the resulting ability to realise better power factors and greater throughput power densities in existing transformers than possible by the usual sinusoidal operation and at lower operating frequencies.

Other objects, features and advantages of the present invention will be apparent when the detailed description of the preferred embodiments is considered in conjunction with the drawings, which should be construed in an illustrative and not limiting sense.

DETAILED DESCRIPTION OF THE PREFERRED EMBODIMENT

Although the present invention is applicable to heat engines and transformers in general, it is most conveniently construed in terms of an electrical heat engine, of either inductive or capacitive type, both to be described, because it is easy to draw the electrical circuit diagrams for such engines. More importantly, an inductive or capative engine is more easily recognisable as a parametric amplifier, characterised by a negative resistance or negative conductance. respectively, as particularly described for a heat engine using self-inductance, inductive engine for short, in U.S. Pat. No. 5,714,829, issued Feb. 3, 1998, entitled *Electromagnetic Heat Engines and Method for Cooling a System Having Predictable Bursts of Heat Dissipation*, so that no flywheel inertia is implied for its operation. The power $P_e$ developed by the engine is instead characterised directly in terms of the mean negative resistance $R_t$ developed by the thermodynamic conversion, as $$P_e=-i^2R_t, \tag{32}$$

the negative sign signifying incoming power to the load circuit. A capacitive engine, similarly constructed using a temperature-sensitive dielectric as the thermodynamic medium, is analogously characterised by a mean negative conductance $G_t$ and develops the power $$P_e=-V^2G_t. \tag{33}$$

The operating point of either engine is best determined in terms of the normalised coherence factor $\alpha$, defined as the ratio of the developed and the load resistances or conductances, respectively, $$\alpha = \frac{R_t}{R_L} \equiv \frac{G_t}{G_L}, \tag{34}$$

where $R_L$ and $G_L$ are the load resistance and conductance, for the respective engines, and the subscript t denotes conversion from heat. The gain factor $\beta$ describes the amplification of both the load circuit power and the load current or voltage in the respective circuit diagrams, to be shown, and is related to $\alpha$ as $$\beta = \frac{1}{1-\alpha}, \alpha = 1 - \frac{1}{\beta}. \tag{35}$$

As remarked, the theoretical insight of eqs. (28)–(31) and the close similarity of transformers to heat engines, as shown by eqs. (11)–(23), can be exploited in reverse to treat a heat engine as a transformer, whose primary side happens to be thermal. Both types of engines are therefore symbolically represented like transformers in the circuit diagrams to be presented, and it will be also shown that not only can mechanical engines be electrically represented by the inductive and capacitive engine circuits, but that mechanical engines can also be combined with the inductive and capacitive forms to construct hybrid engine forms, so that the present invention becomes uniformly applicable to all such engines and combinations.

Figure 1:
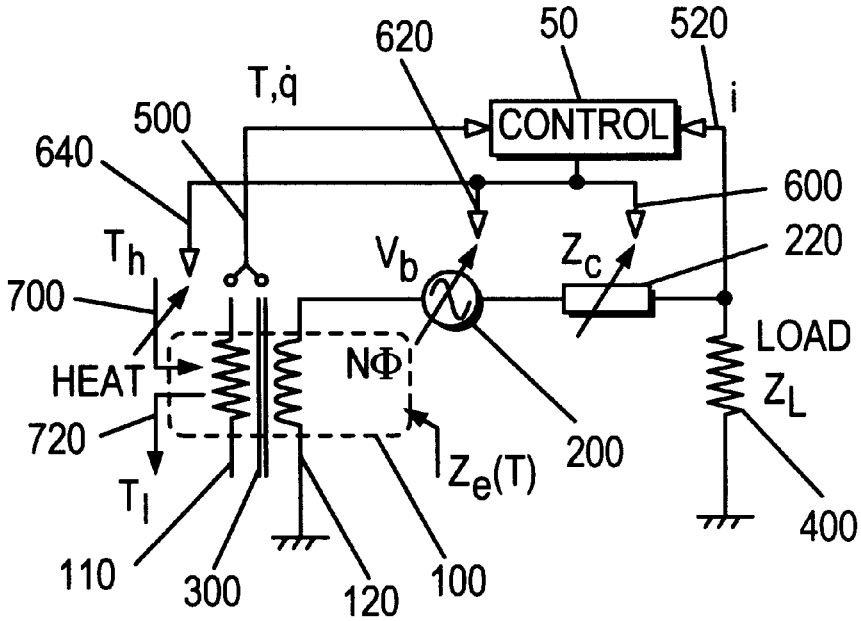
FIG. 1 is a schematic model of a feedback control system for incremental motion in the thermodynamic phase space of a heat engine in accordance with the present invention.

Accordingly, the preferred embodiment is illustrated by the inductive engine of FIG. 1, which shows

- the engine [100] transforming input heat [700] at temperature $T_h$ to output heat [720] at temperature $T_l$ on its input (thermal) side [110] and thereby powering a load [400] in its secondary (load) circuit represented by the coil [120];
- an auxiliary power source [200] capable of producing a variable emf $V_b$ and a variable impedance $Z_c$ [220] connected between the engine [100] and the load [400];
- a control system [50] controlling the impedance $Z_c$ [220] via a first control means [600], the auxiliary power source $V_b$ [200] via a second control means [620], and optionally the heat input to the engine via a third control means [640]:
- temperature T and heat flow $\dot{q}$ sensors [500] embedded in the thermodynamic medium [300] of the engine [100] and connected as inputs to the control system [50]; and
- a load power sensor input [520], detecting the load current i, from the load [400] to the control system [50].

The function of the control system [50], which is central to the present invention, is best understood generically first in terms of the thermodynamic variables $f$ and $\chi$ referenced in the control equation (1), which will be identified with the secondary (load) current i and the reciprocal of the total magnetic flux $N\Phi$ within the engine medium, respectively. It is convenient to think of the equation of state (2) as expressing the dependence of T on $f$ and $\chi$, as $$T=T(f,\chi), \tag{36}$$

so that T can be controlled by manipulating $f$ and $\chi$. More particularly, as already stated, the invention depends on the fact, deriving from the principle of conservation of energy, that the instantaneous rate of change of temperature $\dot{T}$ of the thermodynamic medium is completely determined, but for transients and frictional losses, by the instantaneous heat flow $\dot{q}$ and the instantaneous power developed by the engine, characterised by the piston speed $\dot{\chi}$ (eq. 6). The essence of the present invention, then, is to use existing motion control technology to finely control $\dot{\chi}$ and thereby $\dot{T}$.

Figure 2:
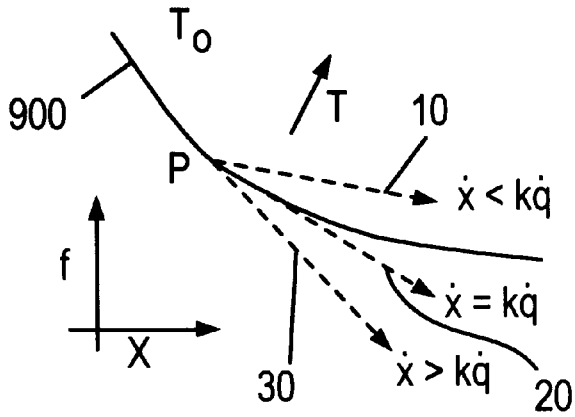
FIG. 2 is a graph illustrating incremental control over the direction of motion in the thermodynamic phase space of a heat engine via its instantaneous piston speed.

FIG. 2 illustrates how this works by considering an operating point P on an isotherm [900] corresponding to a constant temperature $T_0$ in the $f$–$\chi$ phase space. Per eq. (1), for a given heat flow rate $\dot{q}$ occurring at P, there is a particular speed $\dot{\chi}_0$ that would maintain the temperature at $T_0$, computable by setting $\dot{T}=0$ in eq. (1):

$$\dot{x}_0 = -\dot{q}\cdot\left[T\frac{\partial f}{\partial T}\bigg|_x\right]^1 \equiv k\dot{q}, \tag{37}$$

where k denotes the bracketed factor and absorbs the sign. If the speed be adjusted to this value, $\dot{\chi}=k\dot{q}$, the incremental motion at P would proceed tangentially to the $T_0$ isotherm [900], as shown by the broken line [20]. If the speed be set any lower, $\dot{\chi}<k\dot{q}$, the heat inflow would exceed outflow of work and the temperature would rise, as indicated by the broken line [10], and conversely, at speeds in excess of this value, $\dot{\chi}>k\dot{q}$, the heat inflow would be less than the work outflow and the temperature would fall, as shown by the broken line [30]. It is thus possible to execute, within limits imposed by the attainable $\dot{\chi}$ and $\dot{q}$, any chosen thermodynamic process by suitably varying $\dot{\chi}$ with respect to $\dot{q}$. In particular, the required speeds for executing isotherms are computable by setting $\dot{T}=0$ in the control equation, as in eq. (37), and those necessary for executing adiabats are computable by setting $\dot{q}=0$, per the definition of adiabats, obtaining $$\dot{x} = \left(-c_x\dot{T}\right)\cdot\left[T\frac{\partial f}{\partial T}\bigg|_x\right]^{-1}; \tag{38}$$

eqs. (37) and (38) together suffice for determining the speeds necessary for executing Carnot cycles. As previously mentioned, the roles of $\dot{\chi}$, $\dot{q}$ and $\dot{T}$ could be interchanged, but it is difficult to conceive of $\dot{T}$ being anything other than the goal variable for the control system.

Thermodynamically, it only makes sense to prescribe the temperature change, rather than the rate thereof, as suggested by the above equations. The reason for considering the rate is the inevitable presence of quiescent and frictional losses, although they can both be kept in check by appropriate technologies. As remarked earlier, it is useful to operate the engine at high speeds to minimise the relative impact of quiescent losses, although not so fast that the frictional losses, including those due to thermal transport (eq. 30) begin to dominate. Accordingly, if the mechanical friction be sufficiently small, isothermal operations would be ideally performed at a lower speed at which the thermal resistive (transport) loss matches that due to the mechanical friction, and correspondingly, adiabatic operations, in which heat transfer is to be avoided, would be performed at the highest possible speeds to minimise the heat leakage (quiescent) losses. The general prescription for executing Carnot cycles, then, is to follow the adiabats at high speeds and the isotherms at lower speeds, determined by eqs. (38) and (37), respectively, together with the measured values of quiescent and frictional losses.

Figure 3:
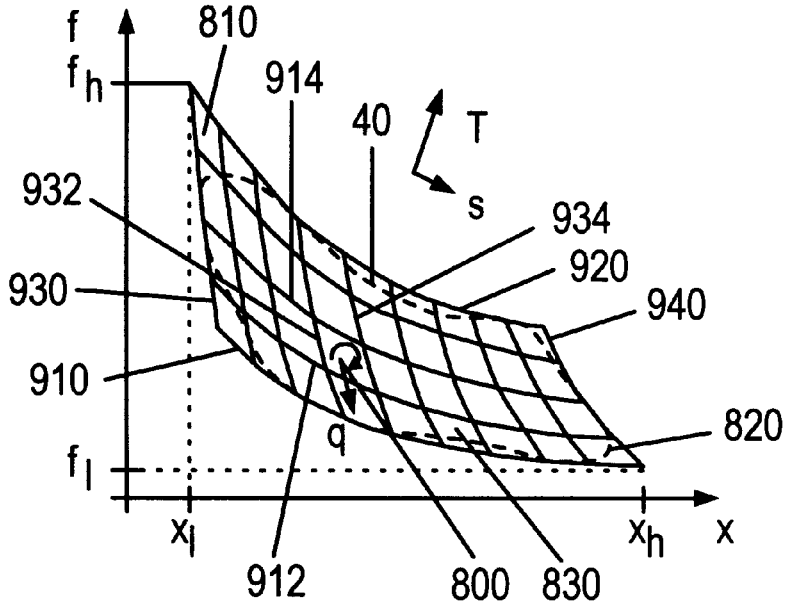
FIG. 3 is a graph of a heat engine cycle for illustrating the notion of incremental control in the thermodynamic phase space.

In order to appreciate why the motion control system is possible and needed, it is useful to consider how the thermodynamic cycle becomes affected in real engines. FIG. 3 shows a family of isotherms between the low and high temperature limits $T_0$ [910] and $T_1$ [920], intersecting a family of adiabats corresponding to the low and high entropy limits $s_0$ [930] and $s_1$ [940], respectively, to form a T–s coordinate grid over the $f$–$\chi$ phase space. It is assumed that T (eq. 36), and therefore s, is single-valued over the region, which is a reasonable assumption for the purposes of analysis since the invention concerns incremental motion and control, and hysteresis and other causes of multi-valued behaviour can be handled by applying the analysis and control technique to incremental portions of the overall cycle. The grid may be thought of as a Carnot grid, in that every combination of a pair of isotherms and a pair of adiabats uniquely defines a Carnot cycle, whose clockwise execution, as shown by the circular arrows, results in the performance of work, together with downward flow of heat q along the adiabat lines as shown for the interior differential cycle [800] bounded by the isotherms [912], [914] and the adiabats [932], [934].

The grid illustrates the thermodynamic Stokes' theorem that an integral engine cycle is equivalent to the sum of differential cycles ("cells") defined by the Carnot grid executed synchronously over identical copies of the whole medium. Correspondingly, for every engine cycle, such as the one shown by the broken line [40], there exists a bounding Carnot cycle, comprising the isotherms and adiabats corresponding to the maximum and minimum temperatures and entropies, respectively, reached in the course of the real cycle, that defines the ideal cycle for that combination of limits. Conceptually, in the operation of the real cycle, all differential cycles (cells) within this bounding Carnot cycle get executed, in order to permit the heat flow q through the medium between each pair of adiabats all the way from the high to the low temperature, but a fraction of the cells are not covered by the engine cycle, and their contribution to the total work is then lost. The shown cycle, [40], cuts on all corners, which can typically occur because of the gradual slowing down of the piston when it reverses direction, as near the corner cells [810] and [820]. The bounds on $\chi$ are set by the piston and crankshaft mechanism and cannot be changed, so the piston displacement $\chi$ cannot be extended to fully cover the corner cell [820], but the cycle itself can be reshaped to sharpen the corner by restricting it to an adiabat of slightly smaller entropy s, i.e. one slightly to the left of adiabat [940], which can be achieved by fine tuning the heat supply, but more conveniently and thoroughly by making the piston motion non-sinusoidal and instead matching it to the heat supply.

Boundary cell [830] illustrates a different kind of problem caused by thermal resistance. Assuming the bounding isotherms to represent the maximum and minimum temperatures available for operating the engine, any non-zero thermal resistivity $\rho$ between the temperature reservoirs must result in a temperature drop $\delta T$ given by eq. (30), which causes the "expansion stroke" to occur at a slightly lower temperature $T<T_h$, and the "compression stroke" to occur at a slightly higher temperature $T>T_l$, so that the effective area of the cycle gets reduced.

Figure 4:
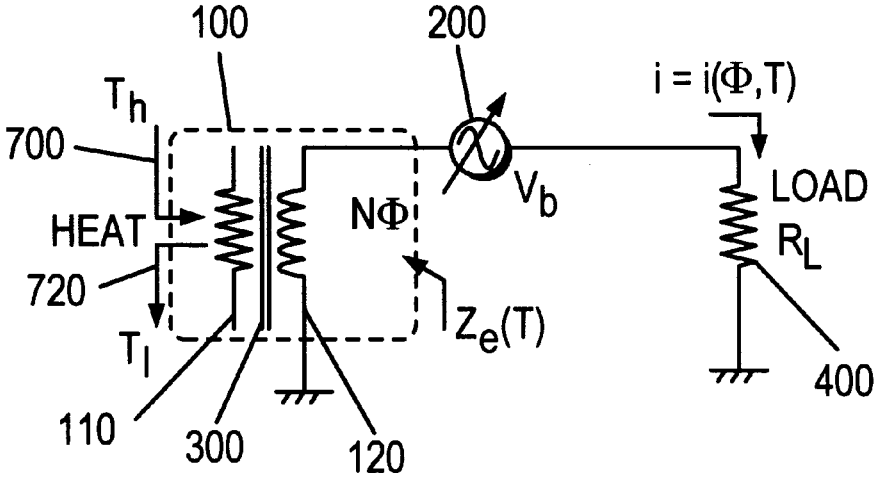
FIG. 4 is a schematic representation of an inductive heat engine and its load circuit.

In order to apply this insight and the control equation, the thermodynamic variables $f$ and $\chi$ must be interpreted in terms of the dynamical variables actually used in the inductive engine. The basic transformer-like structure of the inductive engine [100] is separately shown in FIG. 4 for clarity, and comprises a. the temperature-sensitive thermodynamic medium [300];

b. the thermal primary side [110] comprising means for heat input [700] and output [720] to and from the medium [300], respectively;

c. the coil [120] representing its secondary (load) side; and d. the auxiliary power source [200], needed for driving the engine in lieu of flywheel inertia.

As described in the referenced Patent, the engine cycle involves isothermal "magnetic compression", or magnetising, strokes performed at the lower temperature $T_l$, effectively compressing the orientational degree of freedom of the magnetic dipoles within its medium [300] by an applied magnetic H field generated by the engine current i in the secondary coil [120], and isothermal "magnetic expansion", or demagnetising, strokes performed at the higher temperature $T_h$ as the magnetising current i simultaneously drops, in which the dipoles regain the full amplitude of their angular thermal motion and induce a greater back-emf in the secondary circuit than the emf needed for magnetisation in the compression strokes, separated by the appropriate adiabatic processes. This is, of course, the classical Langevin description, and in the quantum view, the magnetisation and demagnetisation processes involve flipping of the dipoles, the net back-emf being the result of the statistical majority of the dipoles being aligned with the H field at the start of the demagnetisation stroke, as also explained in the referenced Patent. The auxiliary source $V_b$ [200] is needed to drive the magnetising current in the magnetisation strokes, and cannot be a steady d.c. source. Since the direction of magnetisation does not matter to the thermodynamics, the engine can be operated with a.c. instead of pulsed d.c., and performs one thermodynamic cycle for each half of the current (i) cycle.

For the purposes of control, the operation must be characterised in terms of aggregate quantities more suited to the electrical characterisation of the load (secondary) circuit, in place of the magnetic field densities H and B used in the referenced Patent. The integral of B over a cross-section of the magnetic core yields the total magnetic flux $\Phi$ and this times the number of turns N of the secondary coil [120] is readily identified as the magnetic equivalent of the piston displacement $\chi$. One should take the total magnetomotive force (mmf), obtained by integrating H over the core cross-section, as the corresponding force, but since the mmf is always directly proportional to its causative current, regardless of geometry or temperature, it is simpler to formulate the control principles directly in terms of the secondary current i, accordingly starting with the inductive circuit equation of state:

$$i = \frac{N\Phi}{L(T)}, \tag{39}$$

where L is the self-inductance of the coil [120], and varies with the effective temperature T due to the thermal sensitivity of the core, used as the medium [300]. It should be realised that this effective overall T is thermodynamically defined, at the coarse level of the circuit thermodynamical state, differently from a naive averaging of the instantaneous local values of T over the volume of the medium [300], and can vary differently from the local values during the course of the engine cycle. The distinction must be taken into account when setting up the temperature and heat flow sensors [500] and calibrating the control system [50].

The corresponding work differential is $$dw = -i\mathrm{N}d\Phi, \tag{40}$$

where the negative sign represents the fact that an increase in $\Phi$ means work done by the load current i on the medium. Electrical work is performed by the thermodynamically induced back-emf $V_e$ $$V_e = -N\frac{d\Phi}{dt}, \tag{41}$$

so the instantaneous power is $$P_e = V_e i, \tag{42}$$

which tallies with eq. (40). The isotherms in the i-N$\Phi$ phase space are directly obtained from the circuit equation of state by simply setting T constant. The adiabatic equation is obtained by setting dw+cdT=0, c being the applicable heat capacity of the medium, in the equation of state, and is $$i = \left(\frac{c}{L_T}\right)^{\frac{1}{2}}\left(1 - \frac{\Phi}{\Phi_0}\left[1 - \frac{c}{L_T i_0^2}\right]\right)^{-\frac{1}{2}} \tag{43}$$

where $L_T \equiv dL/dT$, and $i_0$ and $\psi_0$ refer to the conditions at any one point on the adiabat.

Figure 5:
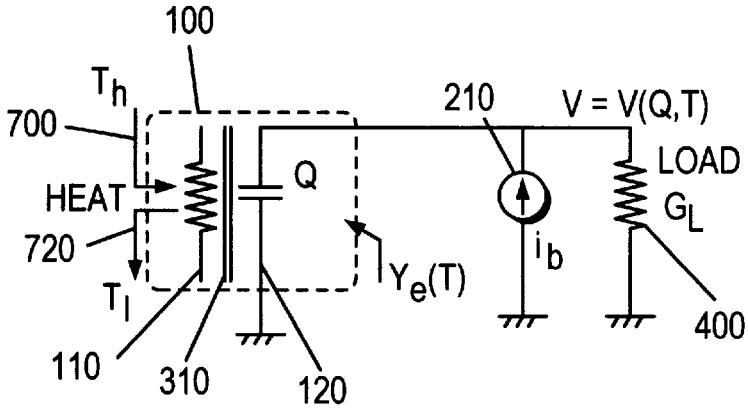
FIG. 5 is a schematic representation of a capacitive heat engine and its load circuit.

The capacitive heat engine is conceptually obtained most simply as the Thevenin's equivalent circuit of the inductive engine, as shown in FIG. 5, and comprises a. the thermodynamic medium [310], which is now a temperature-sensitive dielectric;

b. the thermal primary side [110] comprising similar means for heat input [700] and output [720] to and from the medium [310], respectively;

c. the capacitor [130] using the dielectric [310] representing its secondary (load) side; and d. the auxiliary power source [210], which is now a current source $i_b$, again needed for driving the engine in place of flywheel inertia.

The corresponding circuit thermodynamic variables are the voltage V across the dielectric, representing the force $f$, and the charge Q of the capacitor [130], yielding the capacitive circuit equation of state $$V = \frac{Q}{C(T)}. \tag{44}$$

The work differential is $$dw = -V dQ, \tag{45}$$

and the electrical work is performed via an induced current $$i_e = -\frac{dQ}{dt}, \tag{46}$$

yielding the instantaneous engine power $$P_e = i_e V, \tag{47}$$

matching eq. (45), and leads to the adiabatic equation $$V = \left(\frac{c}{C_T}\right)^{\frac{1}{2}}\left(1 - \frac{Q}{Q_0}\left[1 - \frac{c}{C_T V_0^2}\right]\right)^{-\frac{1}{2}} \tag{48}$$

where c again represents the applicable heat capacity, and $C_T \equiv dC/dT$.

Figure 6:
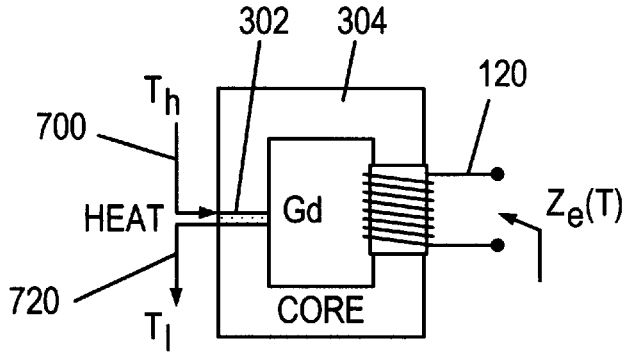
FIG. 6 is a schematic model of an inductive heat engine using gadolinium as its thermo-magnetic element.

It is important to note that only a gross inductance, or capacitance, is required to vary with the temperature, so that only a small segment of the magnetic circuit of a coil, or a sectional area of the dielectric of a capacitor, needs to be subjected to thermal cycles, i.e. varied cyclically in temperature, to obtain an inductive or capacitive engine, respectively, with considerably smaller "thermal mass". A lumped inductance can be generally written as $$L = \mu_r \frac{\mu_0 N A}{l}, \tag{49}$$

where $\mu_0$ is the permeability of free space, A is the effective cross-sectional area of the core, l is its effective length and $\mu_r$, its effective relative permeability. The inductive engine may therefore be constructed as shown in FIG. 6, wrapping the coil [120] on a gapped core [304] and insering a piece of gadolinium [302] in the core gap as shown. This temperature-sensitive piece is then the actual thermodynamic medium, with the rest of the magnetic circuit serving to support the coil and to concentrate its flux on the medium. The variation in L can then be attributed to a relative change in the effective length of the gap, in terms of its reluctance:

$$\frac{L}{L_0} = \frac{\mu}{l} + \frac{x}{l(\mu_x + z)}, \tag{50}$$

where $L_0$ is a nominal inductance value computed from $\mu_0 N^2 A$, l and $\mu$ concern the rest of the core, $\chi$ and $\mu_\chi$ are the effective length and relative permeability of the gap material (gadolinium), and z is a constant accounting for any dead space between the gap material and the core. The temperature variation of $\mu_\chi$ affects the effective path length $\chi/\mu_\chi$ contribution. Analogous ideas are easily derived for capacitive engines.

Figure 7:
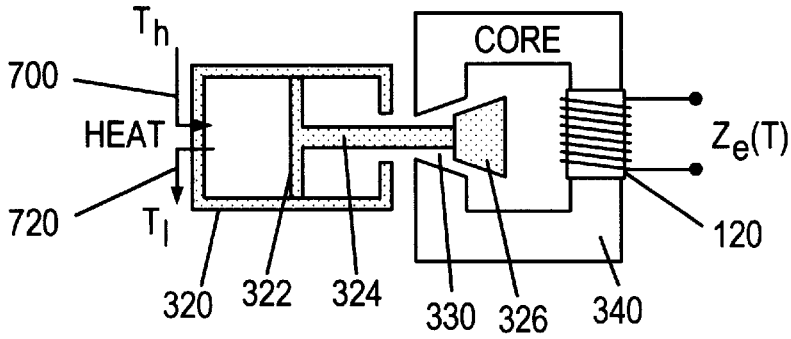
FIG. 7 is a schematic model of an electrically operated hybrid heat engine using the thermal expansion of gas to perform work indirectly through a variable inductance.

The gross reactance can also be varied via the effective cross-sectional area A or the effective length l of its core, and this can be used to construct an electrical heat engine. FIG. 7 illustrates an alternative hybrid construction of the inductive engine, utilising the thermal expansion of a gas in a cylinder [320] to vary the effective area A or length l of the inductor [120]. The pressure of the gas is transmitted by the piston [322] via a shaft [324] to a soft iron plunger [326] that plugs into the specially shaped gap [330] of the magnetic core [340] hosting the engine coil [120]. The cylinder, essentially a mechanical gas heat engine, constitutes the thermal side of the overall engine. Whenever the inductor current increases, the increasing mmf in the core [340] pulls the plunger in to close the gap, thereby varying either or both of A or l depending on the shapes of the gap and the plunger, and compressing the gas in the cylinder [320] in the process. Correspondingly, in the expansion stroke, the gas forces demagnetisation of the core by effectively increasing the gap [330], driving a large back-emf in the coil [120]. Net work results because though the total change in the flux $\Phi$ is the same in both directions, the emf accompanying this flux change is small during magnetisation and is larger during the demagnetisation, due to to the different gas pressures during these processes. The combination works as a single inductive engine, even though the thermal and electrical sides are separated by a mechanical stage comprising the piston [322], the shaft [324] and the plunger [326], and differs from the usual engine-generator combination in that there is no flywheel inertia isolating the generator side from the thermodynamics of the gas engine. Instead, the combination intentionally couples the electrical load circuit into the thermodynamic processes of the gas engine, so that technology available to finely control electrical currents and power can be directly exploited for applying the present invention to gas engines, which are known to be capable of higher power.

Figure 8:
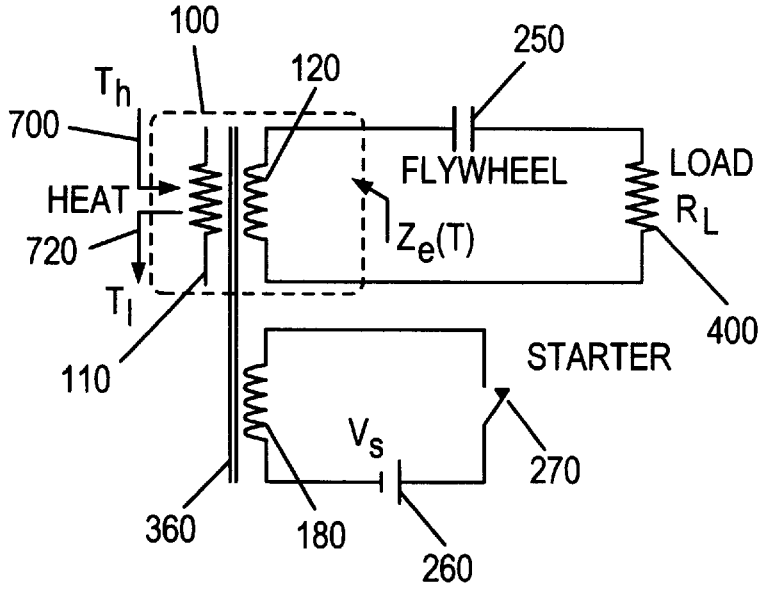
FIG. 8 is an electrical schematic representation of a conventional mechanical heat engine as an inductive engine.

FIG. 8 highlights this distinction by showing the inductive equivalent circuit for a typical prior art mechanical heat engine. The flywheel inertia is represented by a large capacitor [250] in series with the engine inductance [120] and the load $R_L$ [4001]. The capacitor gets charged during each demagnetisation (expansion stroke) and subsequently discharges by driving a current in the reverse direction to cause the next magnetisation (compression stroke). The equivalence lies in the fact that the magnetisation occurs while the magnitude of the current |i| is rising, and demagnetisation concerns decreasing |i|, so that a complete thermodynamic cycle is only one-half of the full a.c. cycle executed by the inductor-capacitor resonant circuit. The thermodynamic conversion parametrically amplifies the electrical energy, but the inductive heat engine is only an amplifier, not a prime mover, hence a separate starter circuit is needed to kick-start the process. The figure shows an inductive starter, requiring an extended core [360] carrying a starter coil [180] driven by a starter power supply $V_s$ [260] controlled by a starter switch [270], which is closed momentarily to induce a small current into the engine secondary coil [120].

The figure is only meant to illustrate how mechanical heat engines may be electrically modelled as inductive or capacitive engines, and more importantly, to demonstrate that the inductive and capacitive forms are indeed dynamically simpler, and may be thought of as canonical forms for heat engines, given that inductance and capacitance, together with resistance, are the simplest form of linear lumped components in electrical circuit analysis. Since a large flywheel reactance [250] forces the piston motion, represented by $d\Phi/dt$, to be sinusoidal, it destroys the possibility of reshaping the engine cycle by incremental control, as described in FIGS. 2 and 3. Indeed, the basic reason that flywheels have been employed in the past is of course to make the mechanical engines self-sustain, and thereby operate as prime movers, i.e., without auxiliary sources of motive power. This means sustaining the piston motion during the compression strokes, and therefore also serves to smoothen the motion. The motive power to the load can be smoothened, if necessary, by other means, as $R_L$ and i represent the load resistance and current, respectively, merely as seen from the engine. The flywheel has thus been traditionally necessary only for sustaining the engine, and has effectively obfuscated the possibility of dynamically reshaping the engine cycle in the prior art. Correspondingly, with the flywheel preventing the piston speed $\dot{\chi}$ from being significantly modulated within each cycle, there was little possibility for reshaping the engine cycle. As a result, the prior art control techniques have been generally limited to matching the timing of the heat input to the operating frequency of the engine cycles, and to controlling only the overall engine speed by varying this frequency.

Accordingly, eq. (1) concerns a much finer control than hitherto possible or envisaged, and in applying it to the inductive engine, the generic thermodynamic variables $f$ and $\chi$ must be replaced by the ones already identified for the circuit equation of state, eq. (39), to get $$N\frac{d\Phi}{dt} = -\frac{\dot{q} + c\dot{T}}{T\partial i/\partial T|_{\Phi}}. \tag{51}$$

The denominator once again can be interpreted as a measurable force-like quantity in the load circuit, $$i_u = [T\partial i/\partial T|_{\Phi}] - i, \tag{52}$$

corresponding to eq. (4). Combining eq. (51) with the expression for the back-emf, eq. (41), and Kirchhoff's law for the load (secondary) circuit of the inductive engine (FIG. 4), yields $$V_b + V_e - iZ = 0, \tag{53}$$

where Z is the total impedance of the circuit $$Z = Z_e(T) + Z_c + Z_L, \tag{54}$$

$Z_L$ being the load impedance ($R_L \equiv \mathrm{Re}(Z_L)$), and $V_e$ is the (back) emf developed by the engine, giving the result $$V_b - iZ_c = \frac{\dot{q} + c\dot{T}}{T\partial i/\partial T|_{\Phi}} - Z_L - Z_e. \tag{55}$$

Thus, a desired instantaneous rate of change of temperature $\dot{T}$, determining the instantaneous direction of motion in the phase space (FIG. 2), can be achieved for any given $\dot{q}$ by varying one or both of the auxiliary source $V_b$ [200] and the control impedance $Z_c$ [220] to satisfy eq. (55).

Figure 9:
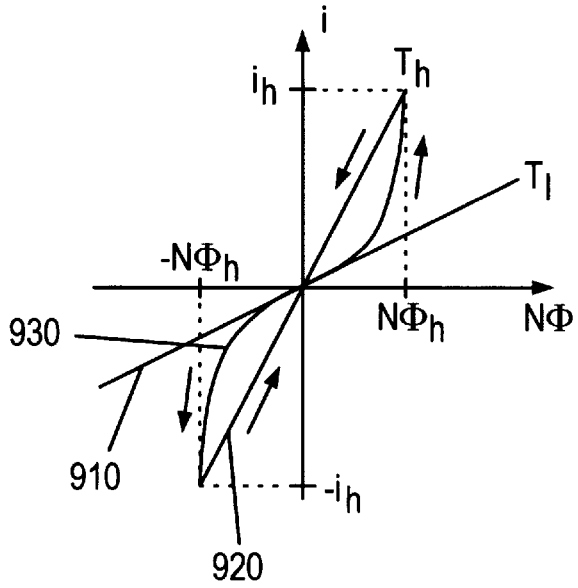
FIG. 9 is a graph of a Carnot cycle for an inductive heat engine in the phase space defined by its magnetic circuit equation of state.

For example, say the control system [50] is to be set to maximise the conversion efficiency by closely following the Carnot cycle of FIG. 3 between the two temperatures $T_h$ (isotherm [920]) and $T_l$ (isotherm [910]), bounded by the adiabats [930] and [940], which determine lower ($\chi_l$) and upper ($\chi_h$) limits on the displacement $\chi$. As particularly described in the referenced Patent, the displacement $\chi$ corresponds to $M^{-1} \sim (N\Phi)^{-1}$ because of the negative sign in the work relation eq. (40), so that $\chi_l$ and $\chi_h$ define the upper and lower limits on the flux $(N\Phi_h) = \chi_l^{-1}$ and $(N\Phi_l) = \chi_h^{-1}$, respectively. Moreover, unlike the piston motion of a mechanical gas engine, the current and the flux can change sign in the inductive engine, so that the equivalent circuit of FIG. 8 would really be executing two thermodynamic cycles for each cycle of the electrical current i in its load circuit. This becomes clearer from FIG. 9, adapted from the referenced Patent, which shows the high entropy adiabat [940] vanishing into the origin, so that only the low entropy adiabat [930] survives on both sides of the origin $(i, \Phi) = (0, 0)$, and the isotherms [910] and [920] extend through the origin. The figure cannot be taken literally, however, because the isotherms would be linear and the adiabats, exponential, as shown, only if the magnetic circuit were perfectly paramagnetic. This is approximately true of the gap-based engine of FIG. 6, since the rest of the magnetic circuit, viz. the core [301], contributes negligible reluctance and can be largely ignored. The approximation is however inappropriate for achieving accurate control, so the exact form of the isotherms and adiabats must be plotted, in all cases, from the circuit equations of states given above using measured data for the temperature dependence in $L_T$ and $C_T$, so that FIG. 9 is only of conceptual utility. The use of empirical data is also important for taking hysteretic effects into account, which could cause $f(\chi, T)$ to become multi-valued over the operating range; such effects necessarily manifest as path-dependent variations in the derivative $\partial i/\partial T|_{\Phi}$ and would be automatically corrected for by the feedback control of the present invention.

In view of this, and also to more closely relate to familiar thermodynamics, it is preferrable to continue to refer to FIG. 3 in designing the control system [50]. In prior art, the theoretical conversion efficiency $\eta$ of a heat engine (eqs. 25, 26) is inherently determined by the construction and operating principles of the engine, and the only degrees of freedom are the output power and operating frequency, or overall speed. As already stated, the overall speed is not of concern in the present invention, so, for the purposes of comparison, it should be assumed that the frequency of execution of the engine cycles is controlled by other means. The only remaining room for control, then, has been in the heat input q, which can be varied to increase or decrease the output power $P_e$.

The presence and involvement of the auxiliary source $V_b$ [200] with the inductive engine [100], and correspondingly $i_b$ [210] in the equivalent capacitive form (FIG. 5), introduces an fundamentally new degree of freedom in the operation by allowing the shape of the engine cycle to controlled, and thence the theoretical efficiency $\eta$, independently of the frequency of its execution. More particularly, for a given cyclic variation in $\dot{q}$, which is in any case necessary for operating a heat engine, it now becomes possible to vary the rate of change of temperature $\dot{T}$ by varying $V_b$, $Z_c$ or both to satisfy eq. (55). Specifically, while executing an isotherm [910] or [920], $\dot{T}$ should be kept zero, so that eq. (55) reduces to $$V_b - iZ_c = \dot{q} \cdot \left[ T \frac{\partial i}{\partial T}\bigg|_{\Phi} \right]^{-1} - Z_L - Z_e, \tag{56}$$

corresponding to eq. (37), so that any unforeseen variations in $\dot{q}$ detected by the sensors [500], as well as non-linearities in the thermal characteristics of the medium, represented by the denominator $T\partial i/\partial T|_{\Phi}$, can be immediately compensated by simply varying $V_b$ or $Z_c$ appropriately. The condition $\dot{q}=0$ likewise yields $$V_b - iZ_c = (-c_x \dot{T}) \cdot \left[ T \frac{\partial i}{\partial T}\bigg|_{\Phi} \right]^{-1} - Z_L - Z_e, \tag{57}$$

for executing the adiabat [930], corresponding to eq. (38). As thermodynamics does not dictate a preferred rate of change of temperature, any choice of $\dot{T}$, and therefore of $V_b$ and $Z_c$, should be adequate in theory. However, as previously remarked, the main reason why it is difficult to follow adiabats is thermal leakage, which makes the true $\dot{q}$ non-zero. It is therefore necessary to make $\dot{T}$ as large as possible, relative to the leakage $\dot{q}$, and therefore $V_b - iZ_c$, that is, $|V_b|$ should be made as large as possible, and $|Z_c|$ very small, in order to closely approximate to the true adiabat. It might be noticed that the sensory feedback is thus irrelevant during the adiabatic processes, but the conclusion also underscores the premise of the present invention that the purely sinusoidal operation of prior art engines is indeed detrimental to their performance.

Figure 10:
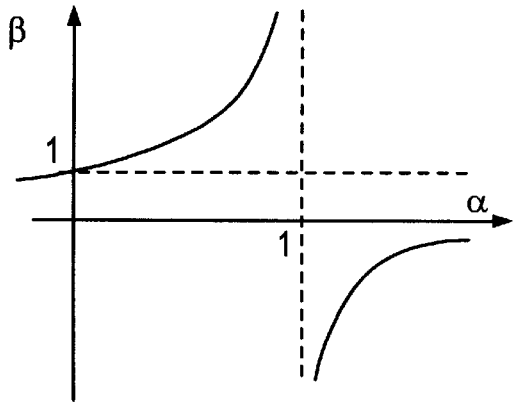
FIG. 10 is a plot of the power gain of an inductive or capacitive heat engine as a function of the normalised negative resistance or conductance, respectively, developed by the engine.

It should be realised that the opportunity for controlling the thermodynamic efficiency $\eta$ is fundamentally distinct from the variability of the power gain $\beta$ (eqs. 32–35) described in the referenced Patent. While $\eta$ relates the converted power $P_e$ to the input heat flow rate, $\beta$ relates $P_e$ to the power $P_b$ supplied by the auxiliary source, which signifies the energy of compression needed to sustain the operation, $$P_b = \nu \cdot \int_{T=T_l} f \, dx, \tag{58}$$

where $\nu$ is the operating frequency, that is, the frequency at which the engine cycle is repeated, and the integral is evaluated over the low temperature isotherm [910] and the low entropy adiabat [930] in FIG. 3. A non-zero $P_b$ is clearly necessary for thermodynamic conversion, as there would otherwise be no compression and no thermodynamic cycle, implying that the ideal operating point $\alpha \to 1$, $\beta \to \infty$, where the drain on the auxiliary source would be eliminated, is indeed physically impossible, as underscored by the fact that $\beta$ not only diverges to $\infty$ at $\alpha=1$, but also changes sign, as shown by the graph of eq. (3.5) in FIG. 10. FIG. 3 indicates that a high $\beta$ can be achieved by lowering the low temperature bound $T_l$ and raising the high temperature bound $T_h$ of the cycle. This would also increase $\eta$, but $\eta$ can be, and commonly is, compromised by deviating from the ideal (Carnot) geometry, as illustrated by the broken path [40], regardless of the temperature and displacement bounds that determine $P_b$.

The power gain $\beta$ thus determines only the gross operating point of the engine and $\eta$ concerns the geometrical precision of the phase space cycle. Typically, therefore, one would use the control system [50] as described above to achieve and maintain a high efficiency $\eta \approx \eta_c$, while allowing the operating frequency $\nu$ and the total output power $P_L = P_b + P_e$ to be vary considerably, for example, in motive applications. One then varies the heat flow rate to vary the output power; as the heat flow increases, the high temperature isotherm [920] rises in temperature ($T > T_h$), increasing the output force $f_h$ on the load. For a fixed load inertia, as is often the case with loads driven by mechanical heat engines, this results in increasing speed, raising $\nu$. Conversely, the speed of mechanical heat engines is very often reduced by by decreasing the heat flow rate. All through, the control system [50] strives to maintain the efficiency $\eta$ independent of which way $\nu$, which defines the average engine speed, varies. A moderate $\beta$ is clearly sufficient in such applications, and the fact that the auxiliary power gets consumed is not in itself a critical issue as long as $\beta > 1$, since the auxiliary source can replenished by tapping a portion of the converted power $P_e$.

On the other hand, it would be generally desirable in power plant applications to set $\beta$ as high as possible so that very little power is drawn from the auxiliary source. However, this would also make the operating point very sensitive to load fluctuations, as $\beta$ depends on $R_L$ via eqs. (34–35). The load power sensor [520] (FIG. 1) is therefore necessary to provide the appropriate feedback to the control system [50], in the form of the load current i. Should the load resistance drop for any reason, the current i would rise immediately; the control system [50] would then reduce $V_b$, or increase $Z_c$, to quickly check the rise in i and the load consumption $P_L \equiv i^2 R_L = P_b + P_e$, the purpose being not so much to protect the auxiliary source or the load, but simply to maintain the conversion efficiency by preventing sudden excursions in the engine current i that would cause the instantaneous motion in the phase space to deviate from the preset cycle, per the conservation of energy principle eq. (6) and the phase space considerations of FIG. 2. Thus, although i appears on the left side of the control equation (55), it is really as much an input to the control computation of $V_b$ and $Z_c$ as $\dot{q}$ and $\dot{T}$.

The foregoing principles of operation would be analogously applicable to the capacitive realisation of FIG. 5, with Kirchhoff's law (see eq. 53) becoming $$i_b + i_e - VY = 0 \tag{59}$$

for the capacitive engine load circuit, and yielding the control equation $$i_b - VY_c = -\frac{\dot{q} + c\dot{T}}{T\partial V/\partial T|_Q} - Y_L - Y_e, \tag{60}$$

corresponding to eq. (55), with $G_L \equiv \mathrm{Re}(Y_L)$, $Y_L \equiv Z_L^{-1}$, etc., from which the capacitive equivalents of the isothermal and adiabatic control equations (56, 57) can be trivially obtained by once again setting $\dot{T}=0$ and $\dot{q}=0$, respectively.

To review, it has been established that to minimise the impact of unavoidable thermal leakages, adiabats must be executed at the highest speeds permissible by the physical construction and the mechanical frictional losses, whereas the isotherms must be executed at speeds matching the available heat flow rate and preferably slowly to minimise the temperature loss due to thermal resistance. These contradictory requirements guarantee that the simple sinusoidal piston motion of prior art cannot be thermodynamically optimal, and must be replaced by a more complicated motion profile matching the Carnot cycle and the heat flow. Since the motion is to be periodic nevertheless, a first order implementation would be as a static, open-loop design for the control system [50]. As alternating motion of energy is involved, for compressing and expanding the medium every cycle, the auxiliary source $V_b$ [200] ($i_b$ [210] in the capacitive version) itself needs to be alternating, or a.c., in form, so that the non-sinusoidal profile would be conveniently implemented by modulating $V_b$ (or $i_b$) via the control means [620], provided the modulation can be kept in perfect synchronisation with the engine frequency ν. There would be little need to include the control impedance $Z_c$ [220] in series (correspondingly, a control admittance $Y_c$ in parallel for the capacitive realisation, per eq. 60). Alternatively, an unmodulated sinusoidal emf source could be used for $V_b$, the modulation of the current i being instead effected by a non-linear design of $Z_c$ as a filter, for example using switched capacitors, as the instantaneous value of $V_b$ varies through the cycle. Because of the abrupt changes of piston speed envisaged at the corners of the Carnot cycle (FIG. 3), a good filter realisation of $Z_c$ would involve multiple poles and zeros. The control means [600] would be vacuous in such a case and the control of $V_b$ via [620] would be mostly confined to varying the amplitude of $V_b$ in step with variation of $\dot{q}$ via control means [610] to match varying load demand. As already mentioned, for reasons such as hysteretic effects and unpredicable fluctuations in the heat supply and the load, an adaptive closed-loop control would be preferrable in many applications, and can be realised in a variety ways well known in control engineering in general.

Figure 11:
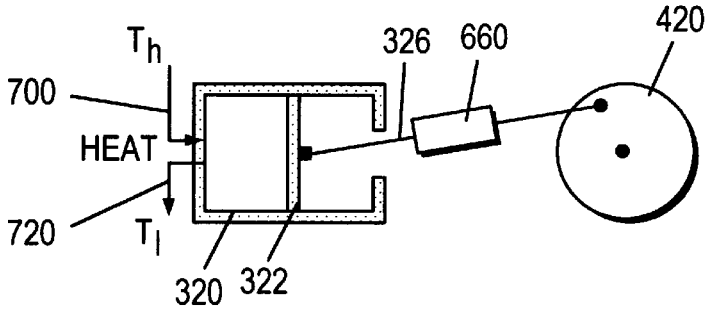
FIG. 11 is a schematic model of a mechanical heat engine adapted to allow piston speed modulation in accordance with the present invention.

While such approaches are generally applicable equally to mechanical engines, FIG. 11 particularly shows how in a mechanical implementation, a linear actuator [660] incorporated in the crankshaft [326] of a conventional reciprocating heat engine, can be used to realise non-sinusoidal motion of the piston [322] as prescribed above, while keeping the motion of the flywheel [420] continuous and smooth. Additionally, since the flywheel [420] would provide sufficient reactive energy for powering the compression strokes, thus performing the function of the flywheel reactance [250] of FIG. 8, the design obviates the need for an auxiliary mechanical power source. The flywheel also replaces the reactance aspect of the control impedance $Z_c$ [220] in FIG. 1, so that the actuator may be thought of as the control means [600] modulating this reactance to produce the non-sinusoidal piston motion.

Figure 12:
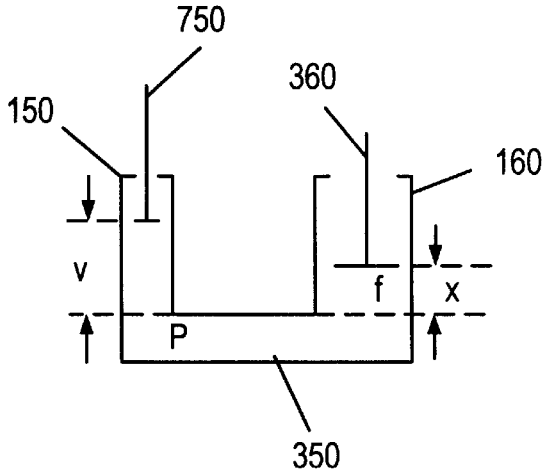
FIG. 12 is a schematic model of a mechanical transformer illustrating the applicability of piston motion control in mechanical transformers.

Finally, FIG. 12 illustrates the close dynamical analogy between heat engines and mechanical, and equivalently electrical, transformers. As described for eqs. (11–23), a mechanical transformer closely resembling a heat engine would be essentially a chamber [350] containing a gaseous medium, with the primary side comprising cylinder [150] and piston [750], and the secondary (load) side similarly comprising cylinder [160] and piston [360]. The load side dynamical variables $f$ and $\chi$ are directly interpretable as the force on the piston [360] and its displacement within the cylinder [160] as shown. The primary side variables can be variously interpreted; for closely analogy with the intensive nature of the temperature T, the pressure of the gas (medium) in the chamber [350] is preferred as the equivalent of T and the volume displacement v of the primary piston [150] then corresponds to the entropy s, which has been previously identified as the thermal form of displacement (eqs. 28–30).

The dynamical equivalence of heat engines to mechanical transformers, shown by eqs. (11–23) above, means that the control principles described for heat engines above are equally applicable to mechanical and electrical transformers for executing equivalent "Carnot" cycles in the respective phase spaces, the principal difference being that η merely signifies the power factor in the context of transformers (eq. 31). The foregoing theory implies that the Carnot cycle would again guarantee the maximum conversion regardless of the transformer operating frequency ν, promising higher throughput and power factor. Adaptation to electrical transformers is quite straightforward, given the inherent similarity of the inductive engine to a conventional transformer. Typically, the "thermal dynamical" variables T, the temperature, and s, the entropy, in the inductive engine implementation of FIG. 1 would be replaced by suitable electrical variables relevant to the transformer primary, such as the primary voltage $V_p$ and current $i_p$, in interpreting the control equations (51–57) above and the phase space of FIG. 3; the primary side [110] and the heat flows [700] [720] of the inductive engine would be replaced by a primary coil; and the temperature and heat flow sensors [500], by voltage and current sensors monitoring $V_p$ and $i_p$ respectively. The procedure for adaptation to mechanical transformers, as well as to more complex electromechanical systems, then essentially involves using mechanical equivalents in place of the electrical quantities and components in the load circuit. In general, the fact that the Carnot cycle principle is identically valid for a non-thermal primary side (eqs. 11–23) means that it is generally useful to all transformations of energy and the key feature of the present invention, that the control is essentially applied to the load subsystem, allows it to be easily applied by the skilled practitioner to every transformation of power involving a mechanical or electrical load.

Advantages

It would be appreciated from the foregoing that the present invention provides a novel method for improving the performance of heat engines and transformers by reshaping their respective phase space cycles, and that although it has been described with respect to reciprocating heat engines, adaptations are eminently possible to other forms, such as turbines, hybrids and even distributed heat engines, employing electromagnetic waves, as in the referenced Patent, or even sound. The generality of the invention has been especially established by demonstrating its applicability to both mechanical and electrical heat engines, as well as to hybrid engines constructible by combining the two kinds. Also, while dynamic, or closed-loop control, has been mainly described, static or open-loop adaptations are likely to be especially advantageous in converting existing engines and transformers whose designed cycles deviate significantly from the ideal.

More particularly, the invention provides for incremental control over motion in the phase space, implying a finer control over the engine cycle than ever before possible. This makes it important even for engines, such as magnetic refrigerators, which are already designed to approximate to the Carnot cycle, firstly, because the closed-loop control would automatically correct for any fluctuations in the heat flow rates or loads, which are typical of real world applications;

and fundamentally, because non-uniform or non-sinusoidal piston motion is necessary, and has not been considered in existing theory and design, for achieving the closest approximation with real engines, in order to minimise the effect of thermal leakages during the adiabatic processes, while preserving the available heat flow and keeping the thermal resistive loss in check during the isothermal segments of the cycle.

The present invention would thus be advantageous in almost all heat engine and transformer applications, since, among other things, the incremental cost of incorporating the control is likely to asymptotically vanish over time, regardless of the improvement in efficiency actually achieved in individual instances. Since the component technologies for the control are also likely to be improved indefinitely, the present invention in effect provides means for asymptotically achieving the Carnot efficiency in real heat engines, thus fundamentally adding to our existing thermodynamic perspective. It would be noticed in the same spirit that the fine control is achieved in the present invention with essentially no compromise in the operating speed of the engine, unlike the existing theoretical notions of quasistatic operation, since the modulation is of the piston speed only within each cycle, and is independent of the frequency of repetition of the cycles.

A novel application made possible by the present invention is the emulation of the cycles of existing heat engines, say by an inductive or capacitive engine incorporating the feedback control system as described above. As already mentioned, emulation of other engine cycles was hitherto impossible because prior art heat engines were conceived and constructed to execute fixed form cycles. The invention thus has potential utility in modelling existing engines.

Although the invention has been described with reference to preferred embodiments, it will be appreciated by one of ordinary skill in the relevant arts that numerous modifications and adaptations are possible in the light of the above disclosure. All such modifications and adaptations are intended to be within the scope and spirit of the invention as defined in the claims appended hereto.

What is claimed is:

1. A method for incrementally controlling the direction of motion and the shape of an engine cycle in the thermodynamic phase space of a heat engine having a thermodynamic medium, a load, a piston for dynamically coupling mechanical or electrical power between the medium and the load, and a control means for cyclically modulating the instantaneous ratio of the piston speed to the heat transfer rate through the engine cycle, the method comprising the steps of computing the instantaneous value of said ratio for the desired instantaneous rate of temperature change in the thermodynamic medium and of modulating the ratio accordingly along the engine cycle.

2. The method of claim 1, wherein the modulation is accomplished by varying the instantaneous heat transfer rate.

3. The method of claim 1, wherein the modulation is accomplished by varying the instantaneous piston speed.

4. The method of claim 3, wherein the engine further comprises an auxiliary motive force means for powering the load, and the instantaneous piston speed is varied by varying the auxiliary motive force means.

5. The method of claim 3, wherein the engine further comprises an impedance means between the piston and the load, the method further comprising varying the impedance means to vary the instantaneous piston speed.

6. The method of claim 1, wherein the engine further comprises a sensor means for detecting fluctuations in the load power, the method further comprising the step of varying the instantaneous ratio to correct the fluctuations.

7. The method of claim 1, wherein the engine further comprises a sensor means for determining an instantaneous temperature of the thermodynamic medium, the method further comprising adjusting the instantaneous temperature to a predetermined value by varying the instantaneous ratio.

8. The method of claim 1, wherein the instantaneous ratio is precomputed for all points along a chosen path in the phase space.

9. The method of claim 1, wherein the modulation is used to closely approximate to a Carnot cycle.

10. A heat engine for powering a load, the heat engine comprising a thermodynamic medium, a piston for dynamically coupling mechanical or electrical power between the medium and the load, and a control means for cyclically modulating the instantaneous ratio of the piston speed to heat transfer rate through the engine cycle, wherein the ratio is modulated to obtain a desired instantaneous rate of change of temperature within the medium along the engine cycle and to achieve a desired shape of the cycle in the thermodynamic phase space.

11. The heat engine of claim 10, wherein the ratio is modulated by varying the instantaneous heat transfer rate.

12. The heat engine of claim 10, wherein the ratio is modulated by varying the instantaneous piston speed.

13. The heat engine of claim 12, further comprising auxiliary motive force means for powering the load, wherein the instantaneous piston speed is varied by varying the auxiliary force means.

14. The heat engine of claim 12, further comprising control impedance means, wherein the instantaneous piston speed is varied by varying the control impedance means.

15. The heat engine of claim 12, further comprising sensor means for detecting fluctuations in the load power, wherein the control means varies the instantaneous ratio to compensate for the fluctuations when modulating the ratio.

16. The heat engine of claim 12, further comprising sensor means for determining an instantaneous temperature of the thermodynamic medium, wherein the control means adjusts the instantaneous temperature to a predetermined value when modulating the ratio.

17. The heat engine of claim 12, wherein the control means comprises a feedback means.

18. The heat engine of claim 12, wherein the control means comprises an open loop control.

19. The heat engine of claim 12, wherein the control means comprises a filter.

20. The heat engine of claim 12, wherein the modulation is used to closely approximate to a Carnot cycle.

21. A method for incrementally controlling the direction of motion and the shape of a transformer cycle in the phase space of a transformer having a medium for storage and transmission of mechanical or electrical energy, a primary supply means for dynamically coupling mechanical or electrical power with said medium, a load, and a control means for cyclically modulating the instantaneous ratio of the piston speed to the primary supply power through the transformer cycle, the method comprising the steps of computing the instantaneous value of said ratio for the desired instantaneous rate of change of a pressure-like intensive property of the medium and of modulating the ratio accordingly along the transformer cycle.

22. The heat engine of claim 21, wherein the modulation is used to closely approximate to a Carnot cycle.

23. A transformer for powering a load, the transformer comprising a medium for storage and transmission of mechanical or electrical energy, primary supply means for dynamically coupling mechanical or electrical sower with the medium, a piston for dynamically coupling mechanical or electrical power between the medium and the load, and a control means for cyclically modulating the instantaneous ratio of the piston speed to the primary supply power through the transformer cycle, wherein the ratio is modulated to obtain a desired instantaneous rate of change of a pressure-like intensive property of the medium and to thereby achieve a desired shape of the cycle in the transformer phase space.

24. The transformer of claim 23, wherein the modulation is used to closely approximate to a Carnot cycle.

* * * * *